US007292130B2

(12) United States Patent
Taga et al.

(10) Patent No.: US 7,292,130 B2
(45) Date of Patent: Nov. 6, 2007

(54) FUSIBLE LINK AND BATTERY FUSE UNIT CONTAINING THE FUSIBLE LINK

(75) Inventors: Shunji Taga, Yokkaichi (JP); Masayoshi Nakamura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 353 days.

(21) Appl. No.: 10/973,339

(22) Filed: Oct. 27, 2004

(65) Prior Publication Data

US 2005/0116805 A1 Jun. 2, 2005

(30) Foreign Application Priority Data

Dec. 2, 2003 (JP) ..... 2003-403456

(51) Int. Cl.
*H01H 85/08* (2006.01)
*H01H 85/20* (2006.01)

(52) U.S. Cl. ..... 337/159; 337/186; 337/187

(58) Field of Classification Search ..... 337/159, 337/186, 187
See application file for complete search history.

(56) References Cited

U.S. PATENT DOCUMENTS 4,800,358 A * 1/1989 Takenouchi et al. ..... 337/268
4,808,962 A * 2/1989 Ikeda ..... 337/203
5,631,620 A * 5/1997 Totsuka et al. ..... 337/260
6,067,004 A 5/2000 Hibayashi et al.
6,512,443 B1 * 1/2003 Matsumura et al. ..... 337/189
2003/0156007 A1 * 8/2003 Senda et al. ..... 337/401
2004/0070485 A1 * 4/2004 Andoh et al. ..... 337/198

FOREIGN PATENT DOCUMENTS

JP 2001-052591 2/2001
JP 2001-256878 9/2001

* cited by examiner

*Primary Examiner*—Anatoly Vortman
(74) *Attorney, Agent, or Firm*—Oliff & Berridge, PLC

(57) ABSTRACT

A fusible link adapted to be connected to a battery terminal and a compact and thin battery fuse unit that contains the fusible link and battery terminal. The link, formed by punching out an electrically conductive metallic plate, includes an input side connecting-section, an output side connecting-section, a fusible section having a narrow width and provided between the input and output side connecting-sections, and a resin section enclosing the fusible section. Coupling portions between the fusible section and the input and output side connecting-sections are molded in the resin section. The input and output side connecting-sections are arranged on the angled positions with respect to the fusible section. The fusible link and a battery terminal connected to the input side connecting-section of the fusible link are contained in a casing so that arc portions of the battery terminal are exposed from the casing. The arc portions engage a battery post.

9 Claims, 6 Drawing Sheets

FIG. 2
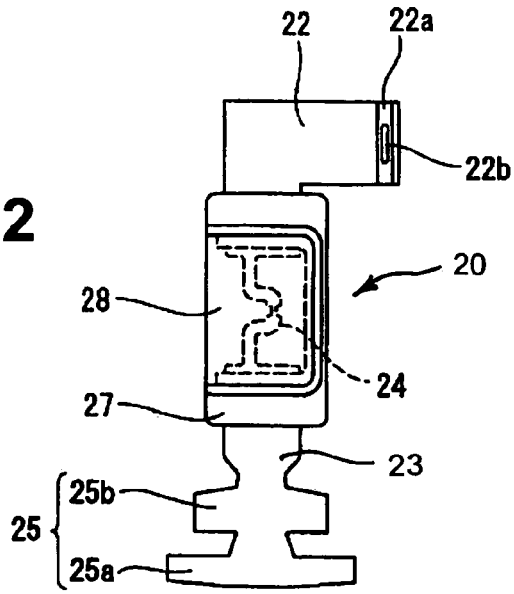
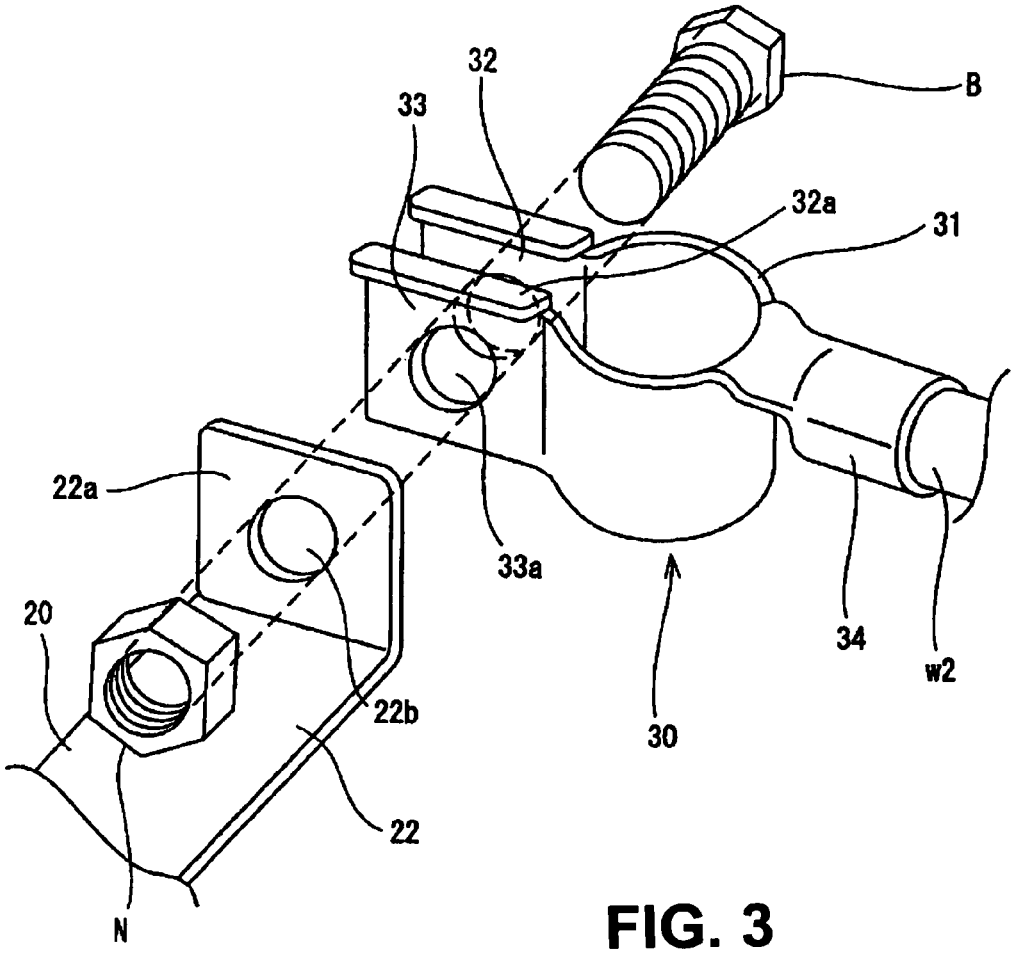
FIG. 3

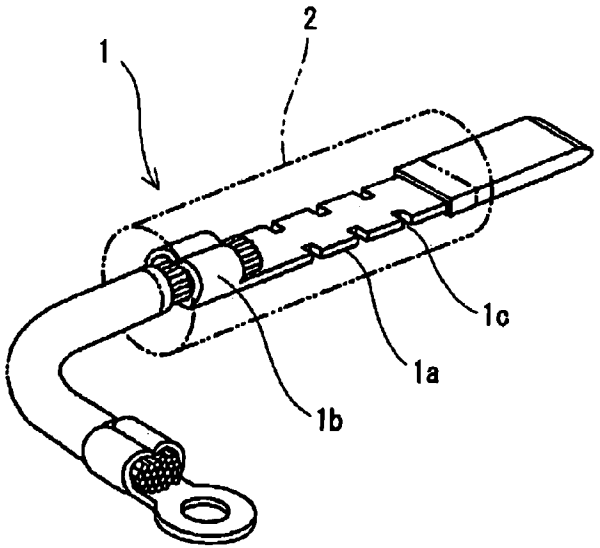
FIG. 7
(Related Art)
FIG. 6A
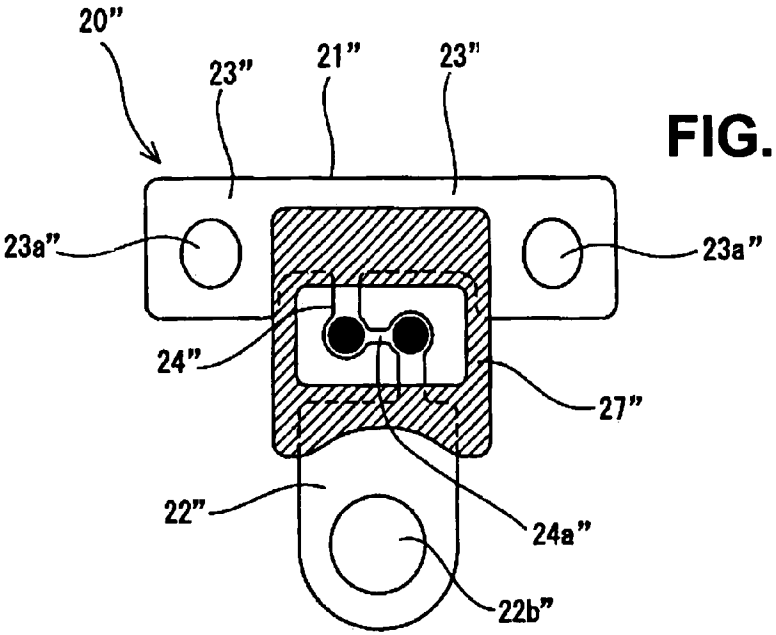
FIG. 6B
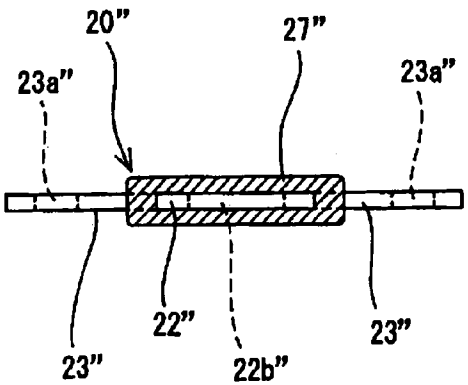

FUSIBLE LINK AND BATTERY FUSE UNIT CONTAINING THE FUSIBLE LINK

CROSS-REFERENCE: TO RELATED APPLICATION

The invention claims priority to Japanese Patent Application No. JP 2003-403456 filed on Dec. 2, 2003. The disclosure of the prior application is incorporated herein by reference in its entirety.

BACKGROUND OF THE INVENTION

1. Field of Invention

This invention relates to a fusible link and a battery fuse unit containing the fusible link and more particularly relates to a fusible link adapted to be connected to a battery terminal to be engaged with a battery post and relates to a battery fuse unit that contains the fusible link and the battery terminal in a casing and is adapted to be mounted on a top part of a battery box.

2. Description of Related Art

Heretofore, an output side electrical cable is connected through a battery fuse to a battery terminal to be connected to a battery post. The battery fuse utilizes a fusible link in which a U-shaped terminal member includes an input terminal section, an output terminal section, a fusible section having a narrow width and provided between the input and output terminal sections, and a resin casing embedding a narrow portion of the fusible section. The fusible link permits upsizing due to the resin casing. When the fusible section is blown out, the fusible section cannot be viewed from outside and may generate smoke due to heat generation, because the fusible section is embedded in the resin casing.

In the case where a battery fuse unit that contains the battery terminal and battery fuse is disposed on a top part of a battery box and the battery terminal is joined to a battery post by bolt and nut means, because the battery fuse to be contained in a casing is upsized, the whole of the unit is upsized. An intermediate terminal is disposed between the battery fuse and the battery terminal in many cases. This increases the number of parts to be contained in the unit.

The applicant has previously disclosed a fuse with an electrical cable, which is not a battery fuse to be connected to the battery terminal, in Japanese Patent Public Disclosure 2001-52591. As shown in FIG. 7, the fuse 1 with an electrical cable includes a substrate 1*a* and a cable crimping-barrel portion 1*b* provided on an end of the substrate 1*a*. The substrate 1*a* has fusible sections 1*c* having narrow widths. The fusible sections 1*c* including the electrical cable crimped in the barrel portion 1*b* are molded in a protection member 2.

In the case of using the fuse 1 with an electrical cable, there is an advantage that an electrical cable is directly connected to the fuse. However, because the protection member 2 contains the fusible sections 1*c*, heat generation due to overcurrent is consumed to melt the molded resin and the fusible section is hardly blown out even by overcurrent greater than a setting value. This will lower reliability in fuse blowing. The blowing in the fusible section cannot be viewed from outside.

Because the above fuse cannot be directly connected to the battery terminal and an input terminal section and an output terminal section are disposed on the opposite ends of the fusible section, when the input terminal section is connected through an intermediate terminal and the output terminal section is connected to an electrical cable, the fuse cannot be efficiently arranged in a casing. This may upsize the battery fuse unit.

SUMMARY OF THE INVENTION

In view of the above problems, an object of various exemplary embodiments of the invention is to provide a fusible link that has a compact and thin configuration, is positively blown out when overcurrent greater than a setting value flows in the fusible link, and a blown portion can be viewed from outside. Particularly, the fusible link connected to a battery terminal is adapted to be contained in a battery fuse unit.

In order to achieve the above object, a fusible link of the present invention formed by punching out an electrically conductive metallic plate includes an input side connecting-section, an output side connecting-section, a fusible section having a narrow width and provided between the input and output side connecting-sections, and a resin section enclosing the fusible section. The input and output side connecting-sections are arranged on the angled positions with respect to the fusible section. Coupling portions between the fusible section and the input and output side connecting-sections are molded in the resin section.

According to the above construction, the resin section encloses the fusible section so that a cavity is defined around the fusible section and the coupling portions between the fusible section and the input and output side connecting-sections are molded in the resin section. Consequently, it is possible to reinforce the fusible section, to protect it from being interfered with external components, and to blow out the fusible section when overcurrent greater than a setting value flows in the fusible section.

The input and output side connecting-sections are arranged in the angled position with respect to the fusible section. In more detail, the fusible link is formed into an L-shape in plan view (or T-shape having one input side connecting section and two output side connecting sections). In comparison with the conventional fusible link in which the input and output side connecting-sections are aligned longitudinally, the fusible link of various exemplary embodiments of the invention can take an efficient arrangement in accordance with the arranged position of the input and output side connecting-sections. For example, the L-shaped fusible link can dispose terminals coupled to the input and output side connecting-sections in parallel to each other. On the other hand, the T-shaped fusible link can couple the respective output members to the rectangular output side connecting-sections.

The input side connecting-section is provided on an end with an inclined projection. The inclined projection is provided with a first bolt hole for joining a mating member. A battery terminal is provided on an end with a pair of fastening pieces for fastening a battery post. Each of the fastening pieces is provided with a second bolt hole. The first and second bolt holes are aligned axially and fastened to each other by bolt and nut means.

According to the above structure, the fastening pieces of the battery terminal and the input side connecting-section of the fusible link can be interconnected by the bolt and nut means directly without using any intermediate terminal. At this time, the inclined projection of the input side connecting-section can be disposed along the fastening pieces of the battery terminal, thereby facilitating a fastening work using bolt and nut means.

The battery terminal can be secured to the battery post by engaging the arc portions of the fastening pieces with the battery post, inserting a bolt into the second bolt holes in a pair of fastening pieces and into the first bolt hole in the input side connecting-section of the fusible link, and fastening the bolt holes by the bolt and nut means. This fastening work using only one bolt can perform a work of securing the battery terminal to the battery post and a work of joining the battery terminal to the input side connecting-section of the fusible link simultaneously.

A third bolt hole is provided in the output side connecting-section. A fourth bolt hole is provided in a male terminal connected to an end of an output side electrical cable. The third and fourth bolt holes are aligned axially and fastened to each other by bolt and nut means.

According to the above structure, the output side connecting-section of the fusible link can be connected to the cable-connecting male terminal directly without using any intermediate terminal. When the fusible section is blown out, the output side connecting-section is disconnected from the male terminal and only the blown fusible link is changed to a new fusible link. This can facilitate a work of changing the fusible link.

An electrical cable crimping barrel portion may be provided on the output side connecting-section.

According to the above structure, because the output side can be connected connecting-section of the fusible link to the electrical cable directly, the number of the parts can be reduced and a bolt-fastening work can be omitted.

A battery fuse unit of various exemplary embodiments of the invention includes the fusible link described above and a battery terminal connected to the input side connecting-section of the fusible link. The battery fuse unit contains the fusible link and battery terminal in a casing so that arc portions of the battery terminal enclose a battery post and are exposed from the casing. The arc portions are adapted to engage the battery post.

The fusible link is formed into a thin configuration and contained in the battery fuse unit. The input side connecting-section of the fusible link is directly connected to the battery terminal. This can reduce the number of parts and make a thin and compact battery fuse unit.

To be more specific, the fusible link is formed into an L-shape in plan view and disposed on an end of the casing having a quadrangular shape in a front and rear direction. The battery terminal is disposed on a side of the casing in a right and left direction. The battery terminal is connected to the input side connecting-section of the fusible link. The output side connecting-section of the fusible link is disposed on the other side of the casing in the right and left direction and connected to an electrical cable connecting terminal or crimped on an electrical cable. According to the above structure, the battery terminal, fusible link, and output side electrical cable can be efficiently contained in the quadrangular casing and to make a compact battery fuse unit, and to reduce an installing space that has been required in the prior art by mounting the battery fuse unit on the top surface of the battery box.

It will be apparent from the foregoing that because the fusible link in the first aspect of various exemplary embodiments of the invention is formed by punching out an electrically conductive metallic plate and includes the fusible section having a narrow width and the input and output side connecting-sections provided angularly on the opposite sides of the fusible section, the input and output side connecting-sections can be arranged in parallel with each other and to make a compact and thin casing that contains the fusible link. Because the fusible section is not molded in the resin section but is enclosed by the resin section, the fusible section can be blown out positively when overcurrent greater than the setting value flows in the fusible section and the blown fusible section can be viewed from outside.

Since the battery fuse unit in the second aspect of various exemplary embodiments of the invention contains the input side connecting-section of the fusible link directly connected to the battery terminal in the casing, it is possible to make a compact and thin battery fuse unit and furthermore to reduce the number of parts. Because the unit is mounted on the battery box directly, it is not necessary to dispose another fuse box and to effectively utilize a restricted space of a vehicle.

BRIEF DESCRIPTION OF THE DRAWINGS

The accompanying drawings, which are incorporated into and constitute a part of the specification, illustrate one or more embodiments of the invention and, taken with the detailed description, serve to explain the principles and implementations of the invention.

In the drawings:

FIG. 2 is a plan view of a fusible link in the battery fuse unit shown in FIG. 1A;

FIG. 3 is a partial perspective view of the fusible link and a battery terminal, illustrating a method for securing the fusible link to the battery terminal;

FIG. 6A is a plan view of a fusible link in a third embodiment of a battery fuse unit in accordance with various exemplary embodiments of the invention. FIG. 6B is a front elevation view of the fusible link shown in FIG. 6A; and FIG. 7 is a perspective view of a conventional fuse.

DETAILED DESCRIPTION OF EXEMPLARY EMBODIMENTS

Figure 1A:
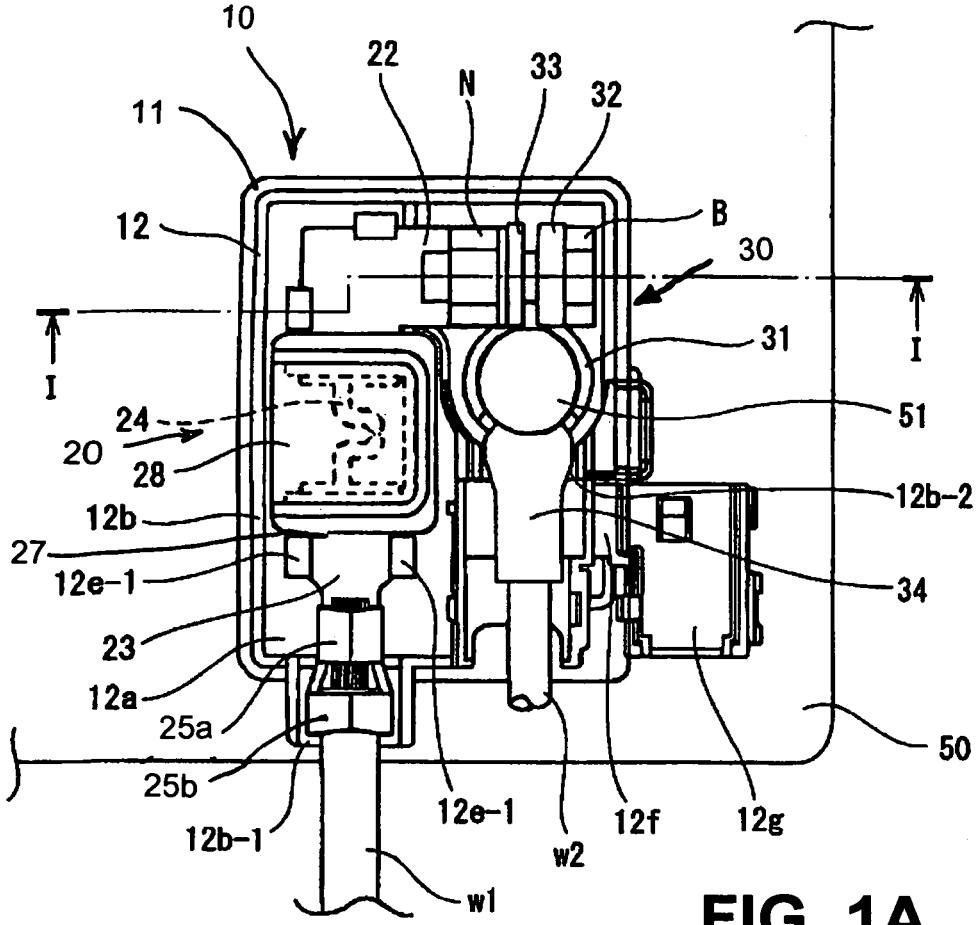
FIG. 1A is a plan view of a first embodiment of a battery fuse unit in accordance with various exemplary embodiments of the invention.

By referring now to the drawings, embodiments of a battery fuse unit in accordance with various exemplary embodiments of the invention will be described below.

FIGS. 1 to 3 show a first embodiment of a battery fuse unit in accordance with various exemplary embodiments of the invention. A battery fuse unit 10 comprises a casing including an upper casing member 11 and a lower casing member 12, a fusible link 20 contained in the casing and connected to an end of an output side electrical cable w1 and a battery terminal 30 contained in the casing and connected to an end of an input side electrical cable w2. The battery fuse unit 10 is secured to an upper surface of a battery box 50 to be mounted on a motor vehicle.

Punching out an electrically conductive metallic plate forms the fusible link 20 to be contained in the battery fuse unit 10. As shown in FIG. 2, the fusible link 20 includes an input side connecting-section 22, an output side connecting-section 23 extending in perpendicular to the section 22, and a fusing section 24 interposed between the input and output side connecting-sections 22 and 23. The fusible link 20 is formed into an L-shaped terminal in plan view. The fusing section 24 is formed into an L-shaped element having a narrow width adjacent the output side connecting-section 23.

The input side connecting-section 22 is provided on an end with an inclined projection 22*a* having a first bolt hole 22*b*. The first bolt hole 22*b* is aligned axially with second bolt holes 32*a* and 33*a* in fastening pieces 32 and 33 of the battery terminal 30 so that the inclined projection 22*a* and fastening pieces 32, 33 are fastened to one another by bolt and nut means. The output side connecting-section 23 includes a first barrel portion 25*a* for crimping an insulation sheath of the output side electrical cable w1 and a second barrel portion 25*b* for crimping a core wire of the cable w1. A protection cover 28 is disposed above the fusing section 24 coupling the input and output side connecting-sections 22 and 23 to each other.

Coupling portions between the fusing section 24 and the input and output side connecting-sections 22 and 23 are molded in a resin section 27 so that the resin section 27 encloses the fusible section 24. The protection cover 28 is formed into a transparent resin cover that has a U-shape in cross section and encloses the opposite sides of the fusing section 24.

As shown in FIG. 3, the battery terminal 30 is coupled to the input side connecting-section 22 of the fusible link 20 and includes a barrel portion 34 for crimping an end of an input side electrical cable w2 of a electrical power source (not shown), arc portions 31 adapted to clamp a battery post 51 (see FIG. 1A) and projected from the barrel portion 34, and a pair of fastening pieces 32 and 33 that extend from both ends of the arc portions 31 and have the second bolt holes 32*a* and 33*a*, respectively.

As shown in FIG. 3, the fusible link 20 is connected to the battery terminal 30 by aligning the first bolt hole 22*b* in the input side connecting-section 22 of the fusible link 20 with second the bolt holes 32*a* and 33*a* in the fastening pieces 32 and 33 axially, inserting a bolt B into the first and second bolt holes 22*b*, 32*a*, 33*a*, and engaging a nut N with the bolt B. The output side electrical cable w1 is connected to a connecting portion 25 (including the first and second barrel portions 25*a* and 25*b*) of the output side connecting-section 23.

Under the above condition, the fusible link 20 and battery terminal 30 are contained in the lower casing member 12 of the battery fuse unit 10.

Figure 1B:
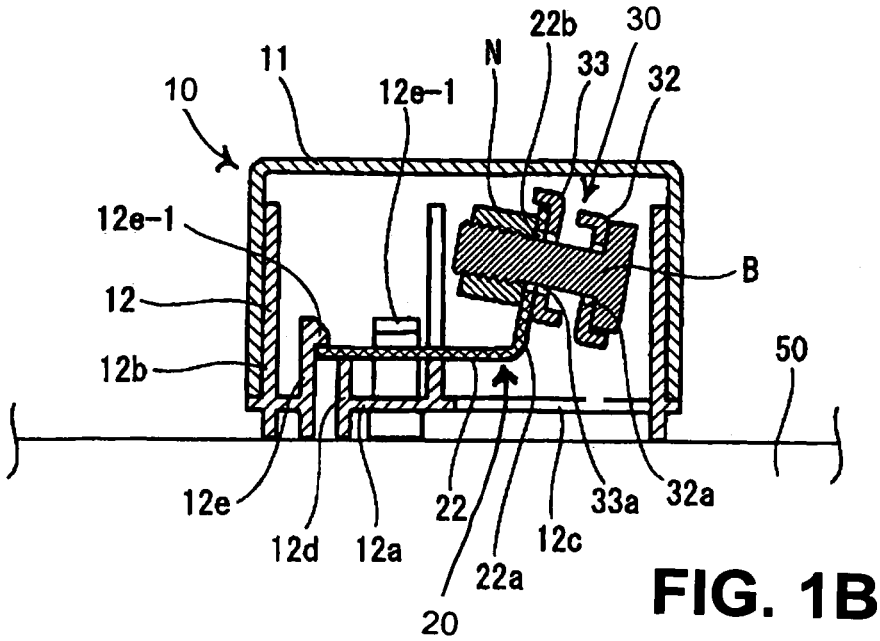
FIG. 1B is a cross sectional view of the battery fuse unit taken along line I-I in FIG. 1A.

As shown in FIGS. 1A and 1B, the lower casing member 12 includes a bottom wall 12*a* and a sidewall 12*b* projecting from the peripheral edge of the bottom wall 12*a*. The battery post 51 of the battery box 50 extends through a through-hole 12*c* in the bottom wall 12*a* into the casing. The arc portions 31 of the battery terminal 30 clamp the battery post 51. The sidewall 12*b* is provided in one side with cable drawing-ports 12*b*-1 and 12*b*-2 to draw out the electrical cables w1 and w2 from the casing in the same direction. The bottom wall 12*a* of the lower casing member 12 is provided with an inner rib 12*d* and an outer rib 12*e* on the position where the fusible link 20 is disposed. A top end of the inner rib 12*d* contacts with a lower surface of the fusible link 20. A pawl 12*e*-1 provided on a top end of the outer rib 12*e* contacts with an upper surface of the fusible link 20. The fusible link 20 is secured to the lower casing member 12. Furthermore, a lid section 12*g* is connected through a hinge portion 12*f* to the lower casing member 12 near the cable drawing port 12*b*-2 to cover the barrel portion 34 of the battery terminal 30.

The upper casing member 11 is joined to the lower casing member 12 to cover a part except the barrel portion 34 of the battery terminal 30. The barrel portion 34 of the battery terminal 30 is covered by the lid 12*g* pivotally connected to the lower casing member 12.

According to the above structure, because the fusing section 24 of the fusible link 20 is not molded with resin but enclosed by a molded resin section 27, a melting action caused in the molded resin section will not absorb heat generated in the fusing section 24 when overcurrent flows in the fusing section 24. Consequently, the fusing section 24 will be blown out when overcurrent greater than a setting value flows in the section 24. This can enhance reliability in fuse blowing. In addition, a blown condition can be visibly confirmed through the transparent cover 28 when the upper casing member 11 is removed.

Upon securing the battery terminal 30 to the battery post 51, the battery terminal 30 can be joined to the input side connecting-section 22 of the fusible link 20 at the same time. This can reduce the number of man-hours and eliminate an intermediate terminal that is disposed between the battery terminal and the fuse and has been essential to the conventional battery fuse unit. This will also reduce the number of parts. Because the fusible link 20 is formed into an L-shape in plan view and connected between the battery terminal and the output side electrical cable, the fusible link 20 can be efficiently contained in a compact and quadrangular casing. Consequently, it is possible to make the battery unit compact. Furthermore, because the fusible link is formed into a conventional fusible link integrated together with a substrate, it can be formed into a thin configuration and thus the battery fuse unit can be also formed into a thin configuration.

Figure 4:
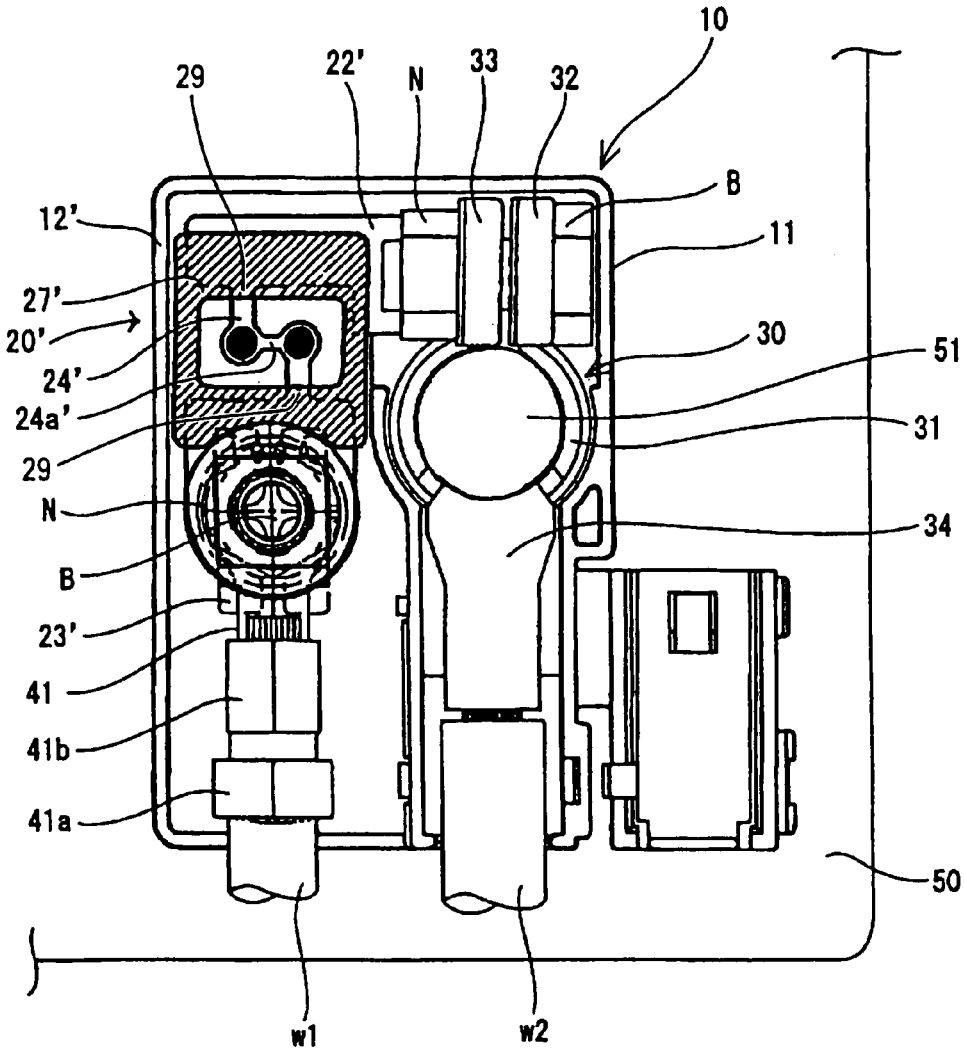
FIG. 4 is a plan view of a second embodiment of a battery fuse unit in accordance with various exemplary embodiments of the invention.

FIGS. 4 and 5 show a second embodiment of the battery fuse unit in accordance with various exemplary embodiments of the invention. The second embodiment differs from the first embodiment with respect to the fusible link.

Figure 5A:
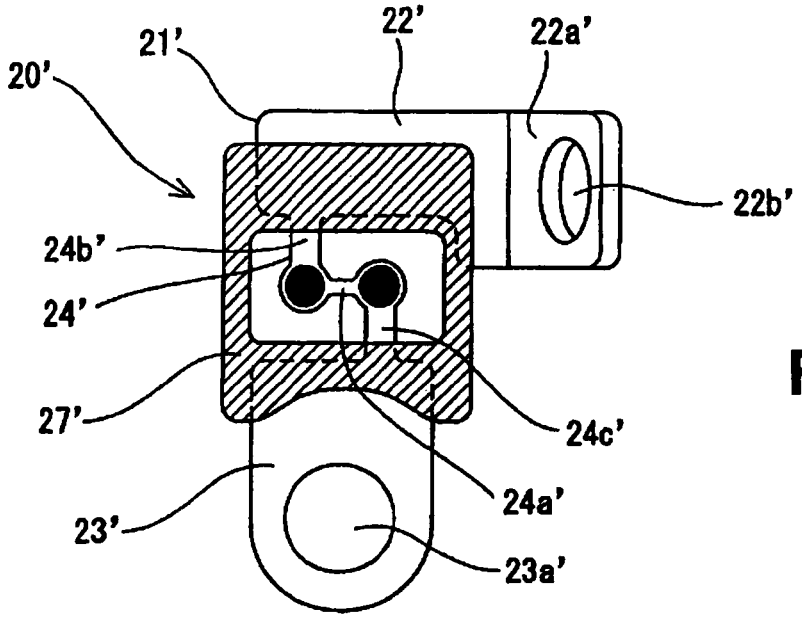
FIG. 5A is a plan view of a fusible link in the second embodiment.
Figure 5B:
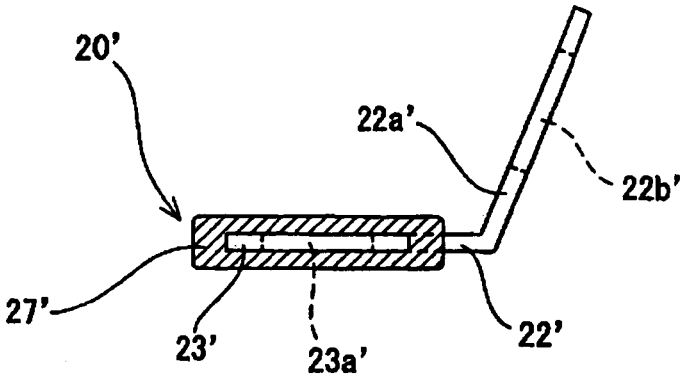
FIG. 5B is a front elevation view of the fusible link shown in FIG. 5A.
Figure 5C:
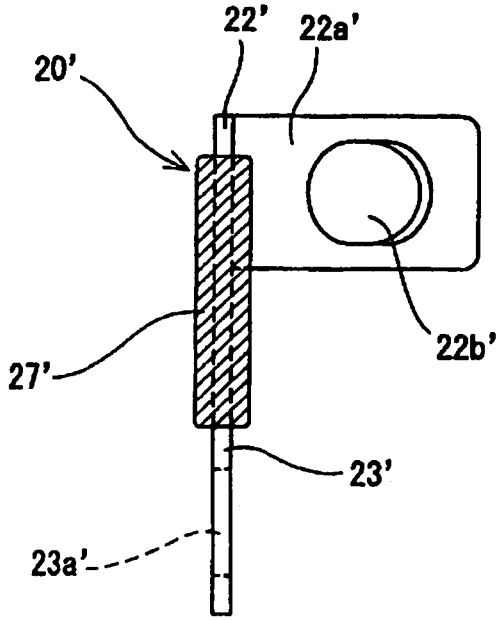
FIG. 5C is a left side elevation view of the fusible link shown in FIG. 5A.

A fusible link 20' in the second embodiment is formed by punching out an electrically conductive metallic plate. As shown in FIG. 5A, the fusible link 20' includes an L-shape terminal having an input side connecting-section 22' and an output side connecting-section 23' bent perpendicularly from the input side connecting-section 22'. A fusible section 24' is provided between the input and output side connecting-sections 22' and 23'. The fusible section 24' is provided with narrow plate portions 24*b*' and 24*c*' extending from the input and output side connecting-sections 22' and 23', respectively. The narrow plate portions 24*b*' and 24*c*' are shifted from each other and their distal ends are coupled through a fusible section body 24*a*' having the narrowest width to each other. The input side connecting-section 22' is provided at the distal end with an inclined projection 22*a*' in the same manner as the first embodiment.

Figure 5D:
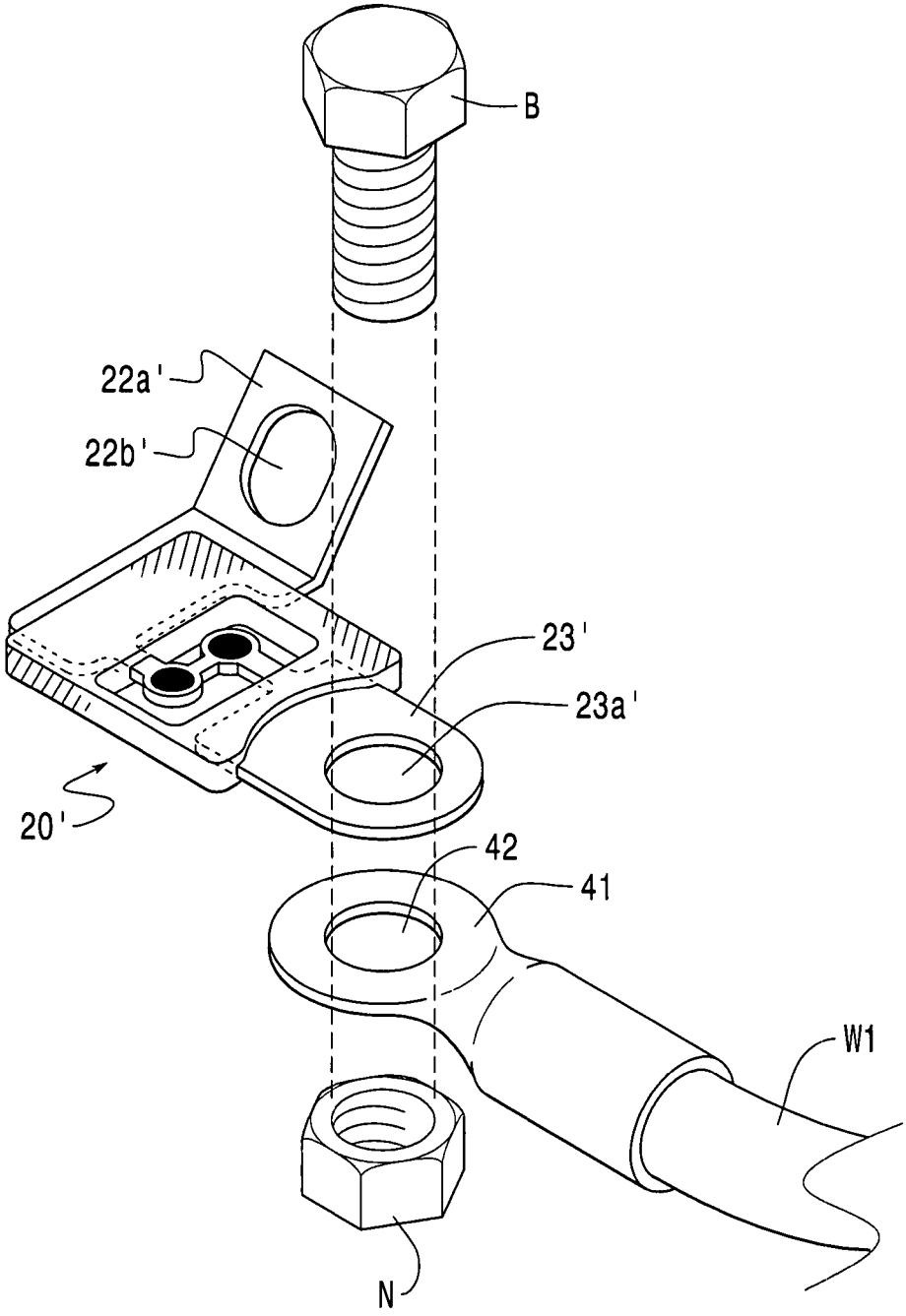
FIG. 5D is a partial perspective view of the output side connecting-section and a male terminal connected to an output side electrical cable, illustrating a method for securing the output side connecting-section to the male terminal.

A first bolt hole 22*b*' is formed in the inclined projection 22*a*' so that the first bolt hole 22*a*' is joined to the fastening pieces 32 and 33 of the battery terminal 30 by the bolt and nut means. On the other hand, as shown in FIG. 5D, a third bolt hole 23*a*' is provided in the output side connecting-section 23' and the third bolt hole 23*a*' is aligned axially with a fourth bolt hole 42 in the male terminal 41 connected to the output side electrical cable w1 so that they are joined to each other by the bolt B and nut N.

A quadrangular frame shape resin section 27' encloses the fusible section 24' with a certain cavity. Coupling portions 29 between the fusible section 24' and the input and output side connecting-sections 22' and 23' are molded in the resin section 27'.

A bolt hole is provided in an end of the male terminal 41 to be connected to the output side connecting-section 23' of the fusible link 20'. The male terminal 41 is provided on the other end with an insulation sheath crimping barrel portion 41*a* and a core wire crimping barrel portion 41*b*. The crimping barrel portions 41*a* and 41*b* are crimped on the output side electrical cable w1.

As described above, the input side connecting-section 22' of the fusible link 20' is joined to the fastening pieces 32 and 33 of the battery terminal 30 by the bolt and nut means in conjunction with the output side connecting-section of the fusible link 20' is joined to the male terminal 41 connected to the end of the output side electrical cable w1. The fusible link 20' constructed above is contained in the lower casing member 12 of the battery fuse unit 10 and the upper casing member 11 is mounted on the lower casing member 12 by the same manner as the first embodiment. The battery fuse unit 10 constructed above is mounted on the upper surface of the battery box 50 and the battery terminal 30 is secured to the battery post 51.

According to the above construction, it is possible to obtain the same effects as those in the first embodiment. It is also possible to utilize the male terminal connected to the electrical cable again so that the male terminal is joined to a new fusible link by disconnecting the output side connecting-section 23' from the male terminal 41 when the fusible section 24' of the fusible link 20' is blown out, because the male terminal 41 connected to the electrical cable is joined to the output side connecting-section 23' by the bolt and nut means.

Since the other constructions and operational effects in the second embodiment are the same as those in the first embodiment, the explanation of them are omitted here merely by giving the same signs to the elements in the second embodiment.

FIG. 6 shows a fusible link in a third embodiment of the battery fuse unit in accordance with various exemplary embodiments of the invention. A fusible link 20" includes one input side connecting-section 22" and two output side connecting-sections 23" to form a T-shaped terminal. The input and output side connecting-sections 22" and 23" are provided with second and third bolt holes 22*b*" and 23*a*", respectively. A fusible section 24" and a resin section 27" enclosing the fusible section 24" with a certain cavity between them are the same as those in the second embodiment.

The input connecting section 22" may be provided on the distal end with an inclined projection in the same manner as the above embodiments.

Because the other constructions and operational effects in the third embodiment are the same as those in the above embodiments, the explanation of them are omitted here merely by giving the same signs to the elements in the third embodiment.

While the invention has been particularly described, in conjunction with specific preferred embodiments, it is evident that many alternatives, modifications, and variations will be apparent to those skilled in the art of the foregoing description. It is therefore contemplated that the appended claims will embrace any such alternatives, modifications, and variations as falling within the true scope and spirit of the invention.

What is claimed is:

1. A fusible link formed by punching out an electrically conductive metallic plate, comprising:

an input side connecting-section provided on an end with an inclined projection, the inclined projection is provided with a first bolt hole for joining a mating member, a battery terminal is provided on an end with a pair of fastening pieces for fastening a battery post, each of the fastening pieces is provided with a second bolt hole, and the first and second bolt holes are aligned axially and fastened to each other by bolt and nut means;

an output side connecting-section;

a fusible section having a narrow width and disposed between the input and output side connecting-sections; and a resin section enclosing the fusible section;

coupling portions located between the fusible section and the input and output side connecting-sections, the coupling portions are molded in the resin section, the input and output side connecting-sections being disposed at respective angles relative to and in proximity to the fusible section.

2. The fusible link according to claim 1, further comprising:

a third bolt hole is provided in the output side connecting-section, and a fourth bolt hole is provided in a male terminal connected to an end of an electrical cable, wherein the third and fourth bolt holes are aligned axially and fastened to each other by bolt and nut means.

3. The fusible link according to claim 1, wherein an electrical cable crimping barrel portion is provided on the output side connecting-section.

4. A battery fuse unit including the fusible link according to claim 1 and further comprising:

a battery terminal connected to the input side connecting-section of the fusible link, the unit containing the fusible link and battery terminal in a casing so that arc portions of the battery terminal enclose a battery post and are exposed from the casing, and the arc portions being adapted to engage the battery post.

5. A battery fuse unit including the fusible link according to claim 2 and further comprising:

a battery terminal connected to the input side connecting-section of the fusible link, the unit containing the fusible link and battery terminal in a casing so that arc portions of the battery terminal enclose a battery post and are exposed from the casing, and the arc portions being adapted to engage the battery post.

6. A battery fuse unit including the fusible link according to claim 3 and further comprising:

a battery terminal connected to the input side connecting-section of the fusible link, the unit containing the fusible link and battery terminal in a casing so that arc portions of the battery terminal enclose a battery post and are exposed from the casing, and the arc portions being adapted to engage the battery post.

7. The battery fuse unit according to claim 4, wherein the fusible link is formed into an L-shape in plan view and disposed on an end of the casing having a quadrangular shape in a front and rear direction, the battery terminal is disposed on a side of the casing in a right and left direction, the battery terminal is connected to the input side connecting-section of the fusible link, the output side connecting-section of the fusible link is disposed on the other side of the casing in the right and left direction and connected to an electrical cable connecting terminal or crimped on an electrical cable.

8. The battery fuse unit according to claim 5, wherein the fusible link is formed into an L-shape in plan view and disposed on an end of the casing having a quadrangular shape in a front and rear direction, the battery terminal is disposed on a side of the casing in a right and left direction, the battery terminal is connected to the input side connecting-section of the fusible link, the output side connecting-section of the fusible link is disposed on the other side of the casing in the right and left direction and connected to an electrical cable connecting terminal or crimped on an electrical cable.

9. The battery fuse unit according to claim 6, wherein the fusible link is formed into an L-shape in plan view and disposed on an end of the casing having a quadrangular shape in a front and rear direction, the battery terminal is disposed on a side of the casing in a right and left direction, the battery terminal is connected to the input side connecting-section of the fusible link, the output side connecting-section of the fusible link is disposed on the other side of the casing in the right and left direction and connected to an electrical cable connecting terminal or crimped on an electrical cable.

* * * * *